US008662924B2

(12) United States Patent
Davis et al.

(10) Patent No.: US 8,662,924 B2
(45) Date of Patent: Mar. 4, 2014

(54) ELECTRICAL CONNECTOR SYSTEM HAVING IMPEDANCE CONTROL

(75) Inventors: Wayne Samuel Davis, Harrisburg, PA (US); Robert Neil Whiteman, Jr., Middletown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 124 days.

(21) Appl. No.: 13/453,619

(22) Filed: Apr. 23, 2012

(65) Prior Publication Data

US 2013/0280957 A1 Oct. 24, 2013

(51) Int. Cl.
*H01R 13/648* (2006.01)

(52) U.S. Cl.
USPC ..... 439/607.07

(58) Field of Classification Search
USPC ..... 439/607.05–607.09, 660
See application file for complete search history.

(56) References Cited

U.S. PATENT DOCUMENTS

| | | | | |
|---|---|---|---|---|
| 7,988,461 | B1 * | 8/2011 | Morgan | 439/78 |
| 8,398,432 | B1 * | 3/2013 | McClellan et al. | 439/607.07 |
| 8,444,435 | B2 * | 5/2013 | Lee et al. | 439/607.07 |
| 8,460,032 | B2 * | 6/2013 | Kirk | 439/607.07 |
| 8,469,745 | B2 * | 6/2013 | Davis et al. | 439/607.07 |

* cited by examiner

*Primary Examiner* — Khiem Nguyen

(57) ABSTRACT

An electrical connector system includes a receptacle connector having a receptacle housing holding a plurality of receptacle signal contacts arranged in pairs carrying differential signals. The receptacle housing has a front face. The system includes a header connector coupled to the receptacle connector. The header connector includes a header housing holding a plurality of header signal contacts arranged in pairs carrying differential signals and mated with corresponding receptacle signal contacts. The header housing has a front face that opposes the front face of the receptacle housing when coupled thereto with a gap being defined between the front faces. Gap fillers are provided within the gap. The gap fillers are conductive and include deflectable spring fingers. The gap fillers provide impedance control for the header signal contacts along the gap.

20 Claims, 8 Drawing Sheets

ELECTRICAL CONNECTOR SYSTEM HAVING IMPEDANCE CONTROL

BACKGROUND OF THE INVENTION

The subject matter herein relates generally to electrical connector systems.

Some electrical systems utilize electrical connectors to interconnect two circuit boards, such as a motherboard and daughtercard. Signal loss and/or signal degradation is a problem in known electrical systems. For example, cross talk results from an electromagnetic coupling of the fields surrounding an active conductor or differential pair of conductors and an adjacent conductor or differential pair of conductors. The strength of the coupling generally depends on the separation between the conductors, thus, cross talk may be significant when the electrical connectors are placed in close proximity to each other. The strength of the coupling also depends on the material separating the conductors. Moreover, as speed and performance demands increase, known electrical connectors are proving to be insufficient. Additionally, there is a desire to increase the density of electrical connectors to increase throughput of the electrical system, without an appreciable increase in size of the electrical connectors, and in some cases, with a decrease in size of the electrical connectors. Such increase in density and/or reduction in size causes further strains on performance.

In order to address performance, some electrical connectors have been developed that utilize shielded contact modules that are stacked into a housing. The shielded contact modules have conductive holders that provide shielding around the contacts of the electrical connectors. However, in some eases, when the electrical connectors are mated, full mating does not occur, leaving an air gap between the connectors. Such air gap has a dielectric constant that is different than the dielectric constant of the material designed to surround the conductors, thus affecting the impedance of the conductors.

A need remains for electrical connectors having improved impedance control to increase the electrical performance thereof.

BRIEF DESCRIPTION OF THE INVENTION

In one embodiment, an electrical connector system is provided that includes a receptacle connector having a receptacle housing holding a plurality of receptacle signal contacts arranged in pairs carrying differential signals. The receptacle housing has a front face. The system includes a header connector coupled to the receptacle connector. The header connector includes a header housing holding a plurality of header signal contacts arranged in pairs carrying differential signals and mated with corresponding receptacle signal contacts. The header housing has a front face that opposes the front face of the receptacle housing when coupled thereto with a gap being defined between the front faces. Gap fillers are provided within the gap. The gap fillers are conductive and include deflectable spring fingers. The gap fillers provide impedance control for the header signal contacts along the gap.

In another embodiment, an electrical connector system is provided including a receptacle connector and a header connector coupled to the receptacle connector. The receptacle connector has a receptacle housing holding a plurality of receptacle signal contacts arranged in pairs carrying differential signals. The receptacle housing has a front face. The receptacle connector has a shield body. The header connector includes a header housing holding a plurality of header signal contacts and a plurality of header ground contacts arranged in pairs carrying differential signals. The header signal contacts are mated with corresponding receptacle signal contacts. The header ground contacts are mechanically and electrically coupled to the shield body to provide ground paths between the header connector and the receptacle connector. The header housing has a front face, wherein the front face opposes the front face of the receptacle housing when coupled thereto with a gap being defined between the front faces. The header signal contacts and the header ground contacts span across the gap. The system includes gap fillers within the gap. The gap fillers are separate from the header connector and coupled to the header ground contacts. The gap fillers are conductive and are electrically connected to the header ground contacts. The gap fillers include deflectable spring fingers spanning across the gap and provide impedance control for the header signal contacts along the gap.

In a further embodiment, an electrical connector system is provided including a receptacle connector and a header connector coupled to the receptacle connector. The receptacle connector has a receptacle housing holding a plurality of receptacle signal contacts arranged in pairs carrying differential signals. The receptacle housing has a front face. The receptacle connector has a shield body. The header connector includes a header housing holding a plurality of header signal contacts and a plurality of header ground contacts arranged in pairs carrying differential signals. The header signal contacts are mated with corresponding receptacle signal contacts. The header ground contacts are mechanically and electrically coupled to the shield body to provide ground paths between the header connector and the receptacle connector. The header housing has a front face, wherein the front face opposes the front face of the receptacle housing when coupled thereto with a gap being defined between the front faces. The header signal contacts and the header ground contacts span across the gap. The system includes gap fillers within the gap. The gap fillers are separate from the header connector and coupled to the header ground contacts. The gap fillers are integrally formed with the header ground contacts. The gap fillers include deflectable spring fingers spanning across the gap and provide impedance control for the header signal contacts along the gap.

DETAILED DESCRIPTION OF THE INVENTION

Figure 1:
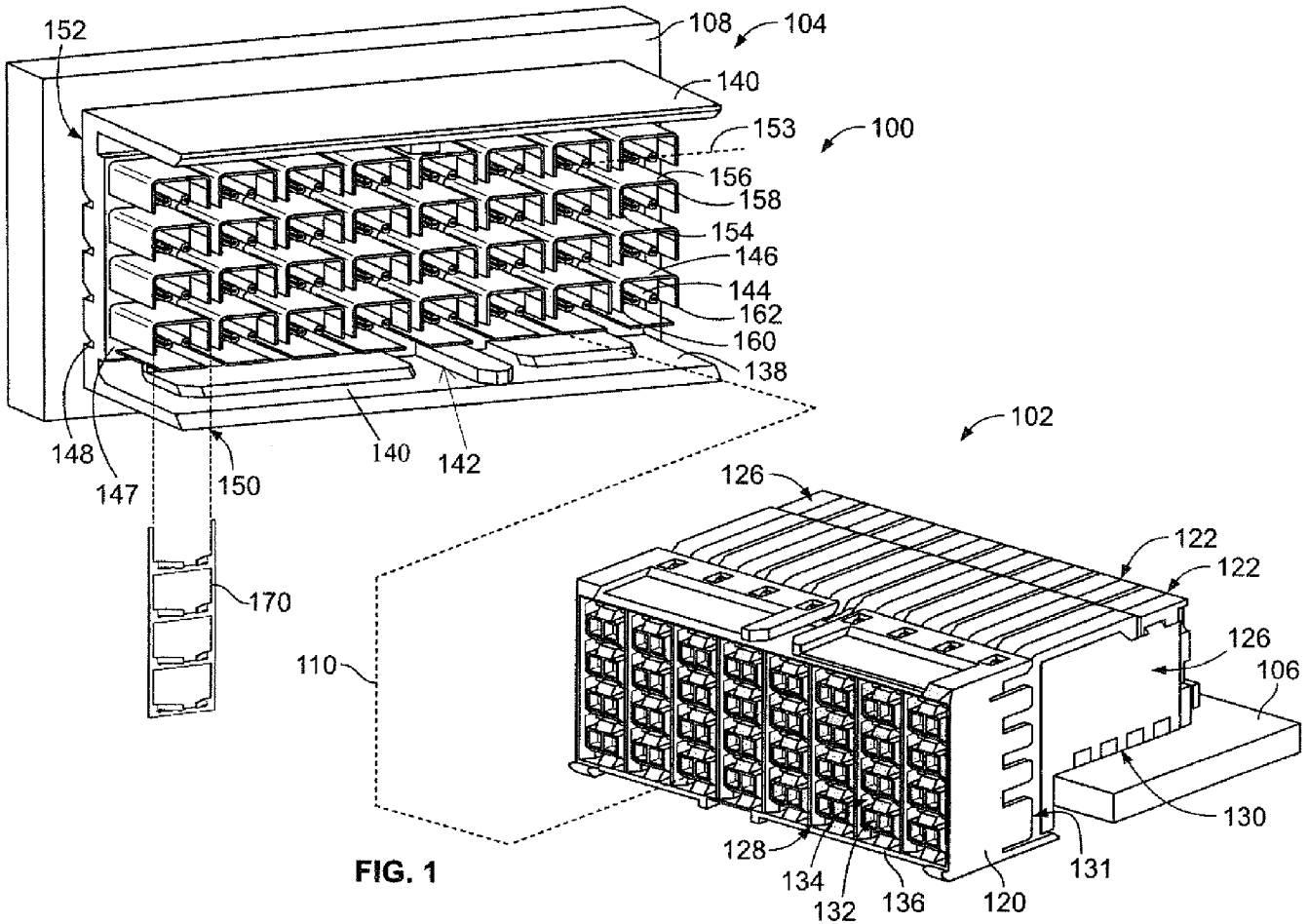
FIG. 1 is a perspective view of an exemplary embodiment of an electrical connector system illustrating a receptacle connector and a header connector.

FIG. 1 is a perspective view of an exemplary embodiment of an electrical connector system 100 illustrating a receptacle connector 102 and a header connector 104 that may be directly mated together. The receptacle connector 102 and/or the header connector 104 may be referred to hereinafter individually as a "connector" or collectively as "connectors". The receptacle and header connectors 102, 104 are electrically connected to respective circuit boards 106, 108. The receptacle and header connectors 102, 104 are utilized to electrically connect the circuit boards 106, 108 to one another at a separable mating interface. In an exemplary embodiment, the circuit boards 106, 108 are oriented perpendicular to one another when the receptacle and header connectors 102, 104 are mated. Alternative orientations of the circuit boards 106, 108 are possible in alternative embodiments.

A mating axis 110 extends through the receptacle and header connectors 102, 104. The receptacle and header connectors 102, 104 are mated together in a direction parallel to and along the mating axis 110.

The receptacle connector 102 includes a receptacle housing 120 that holds a plurality of contact modules 122. Any number of contact modules 122 may be provided to increase the density of the receptacle connector 102. The contact modules 122 each include a plurality of receptacle signal contacts 124 (shown in FIG. 2) that are received in the receptacle housing 120 for mating with the header connector 104. The receptacle housing 120 holds and positions the receptacle signal contacts 124 for mating with the header connector 104.

In an exemplary embodiment, each contact module 122 of the receptacle connector 102 has a shield structure 126 for providing electrical shielding for the corresponding receptacle signal contacts 124. The shield structure 126 may be defined by separate metal shields and/or by conductive or metalized holders for the receptacle signal contacts 124. In an exemplary embodiment, the shield structure 126 is electrically connected to the circuit board 106, and may be electrically connected to the header connector 104 when the receptacle and header connectors 102, 104 are mated. For example, the shield structure 126 may be electrically connected to the header connector 104 by extensions (e.g. beams or fingers) extending from the contact modules 122 that engage the header connector 104. The shield structure 126 may be electrically connected to the circuit board 106 by features, such as ground pins.

The receptacle connector 102 includes a mating end 128 and a mounting end 130. The receptacle signal contacts 124 are received in the receptacle housing 120 and held therein at the mating end 128 for mating to the header connector 104. The receptacle signal contacts 124 are arranged in a matrix of rows and columns. In the illustrated embodiment, at the mating end 128, the rows are oriented horizontally and the columns are oriented vertically. Other orientations are possible in alternative embodiments. Any number of receptacle signal contacts 124 may be provided in the rows and columns. The receptacle signal contacts 124 also extend to the mounting end 130 for mounting to the circuit board 106. Optionally, the mounting end 130 may be substantially perpendicular to the mating end 128.

The receptacle housing 120 defines the mating end 128 of the receptacle connector 102. The receptacle housing 120 also includes a loading end 131 at a rear of the receptacle housing 120. The contact modules 122 are loaded into the receptacle housing 120 through the loading end 131. In the illustrated embodiment, the contact modules 122 extend beyond (e.g. rearward from) the loading end 131.

The receptacle housing 120 includes a plurality of signal contact openings 132 and a plurality of ground contact openings 134 at the mating end 128. The receptacle signal contacts 124 are received in corresponding signal contact openings 132. Optionally, a single receptacle signal contact 124 is received in each signal contact opening 132. The signal contact openings 132 may also receive corresponding header signal contacts 144 therein when the receptacle and header connectors 102, 104 are mated. The ground contact openings 134 receive header ground contacts 146 therein when the receptacle and header connectors 102, 104 are mated. The ground contact openings 134 receive grounding beams 302 (shown in FIG. 2) of the contact modules 122 that mate with the header ground contacts 146 to electrically common the receptacle and header connectors 102, 104.

The receptacle housing 120 is manufactured from a dielectric material, such as a plastic material, and provides isolation between the signal contact openings 132 and the ground contact openings 134. The receptacle housing 120 isolates the receptacle signal contacts 124 and the header signal contacts 144 from the header ground contacts 146. The receptacle housing 120 isolates each set of receptacle and header signal contacts 124, 144 from other sets of receptacle and header signal contacts 124, 144.

The receptacle housing 120 has a front face 136 at the mating end 128. The front face 136 is generally opposite the loading end 131 at the rear. The front face 136 may be substantially planar. The signal and ground contact openings 132, 134 are open through the front face 136. In an exemplary embodiment, the front face 136 may define the forward-most surface of the receptacle housing 120. Optionally, keying features may extend forward of the front face 136 for keyed mating and/or aligning of the receptacle housing 120 with the header connector 104. In an exemplary embodiment, the mating end 128 of the receptacle housing 120, and the front face 136, is plugged into the header connector 104 during mating.

The header connector 104 includes a header housing 138 having walls 140 defining a chamber 142. The walls 140 guide mating of the receptacle connector 102 with the header connector 104. In the illustrated embodiment, the walls 140 are provided at the top and bottom, while the sides are open. Alternatively, the walls 140 may enclose the chamber 142. In other alternative embodiments, no walls 140 may be provided.

The header signal contacts 144 and the header ground contacts 146 are held by the header housing 138. In an exemplary embodiment, the header signal contacts 144 and the header ground contacts 146 extend from a front face 147 of a base wall 148 into the chamber 142. The header signal contacts 144 and the header ground contacts 146 extend through the base wall 148 and are mounted to the circuit board 108. The front face 147 may be substantially planar. The front face 147 defines a back of the chamber 142.

The header connector 104 has a mating end 150 and a mounting end 152 that is mounted to the circuit board 108. The receptacle connector 102 is received in the chamber 142 through the mating end 150. The receptacle housing 120 engages the walls 140 to hold the receptacle connector 102 in the chamber 142. Optionally, the mounting end 152 may be substantially parallel to the mating end 150. Alternatively, the header connector 104 may include contact modules similar to the contact modules 122, which may be held by the header housing 138 and which may define a mounting end that is perpendicular, or at another orientation, to the mating end 150.

In an exemplary embodiment, the header signal contacts 144 are arranged as differential pairs. The differential pairs of header signal contacts 144 are arranged in rows along row axes 153. The header ground contacts 146 are positioned between the differential pairs to provide electrical shielding between adjacent differential pairs. In the illustrated embodiment, the header ground contacts 146 are C-shaped and provide shielding on three sides of the pair of header signal contacts 144. The header ground contacts 146 have a plurality of walls, such as three planar walls 154, 156, 158. The walls 154, 156, 158 may be integrally formed or alternatively, may be separate pieces. The wall 156 defines a center wall or top wall of the header ground contact 146. The walls 154, 158 define side walls that extend from the center wall 156. The walls 154, 156, 158 have interior surfaces that face the header signal contacts 144 and exterior surfaces that face away from the header signal contacts 144. Other shapes are possible in alternative embodiments.

The header ground contacts 146 have edges 160, 162 at opposite ends of the header ground contacts 146. The edges 160, 162 are downward facing. The edges 160, 162 are provided at the distal ends of the walls 154, 158, respectively. The bottom is open between the edges 160, 162. The header ground contact 146 associated with another pair of header signal contacts 144 provides the shielding along the open, fourth side thereof such that each of the pairs of signal contacts 144 is shielded from each adjacent pair in the same column and the same row. For example, the top wall 156 of a first header ground contact 146 which is below a second header ground contact 146 provides shielding across the open bottom of the C-shaped second header ground contact 146. Other configurations or shapes for the header ground contacts 146 are possible in alternative embodiments. More or less walls may be provided in alternative embodiments. The walls may be bent or angled rather than being planar. In other alternative embodiments, the header ground contacts 146 may provide shielding for individual signal contacts 144 or sets of contacts having more than two signal contacts 144. The spacing or positioning of the header ground contacts 146 and the header signal contacts 144 controls an impedance of the signals.

During mating, the receptacle connector 102 is received in the chamber 142 until the receptacle housing 120 abuts against or nearly abuts against the front face 147. When mated, the front face 136 of the receptacle housing abuts against or nearly abuts against the front face 147. The front faces 136, 147 oppose each other when the receptacle and header connectors 102, 104 are mated. In an exemplary embodiment, the receptacle and header connectors 102, 104 are designed to have the front faces 136, 147 abutting against one another when the receptacle and header connectors are mated. In actual implementation, often the front faces 136, 147 do not abut against one another, thereby leaving a gap between the front faces 136, 147. Such gap may be due to manufacturing tolerances. Such gap may be due to variation in mounting positions of one or both of the receptacle and header connectors 102, 104. For example, when used in a system, such as a backplane or server, having many receptacle and header connectors 102, 104 each being coupled together where one set of receptacle and header connectors 102, 104 bottoms out, further loading of other receptacle and header connectors 102, 104 is stopped. Other factors may cause the gap. When the gap is present, the electrical performance of the receptacle and header connectors 102, 104 is diminished. For example, air in the gap raises the impedance of the differential pairs of signals transmitted by the receptacle and header connectors 102, 104 thereby diminishing the electrical performance.

In an exemplary embodiment, the electrical connector system 100 includes one or more gap fillers 170 that are configured to be positioned in the gap between the receptacle connector 102 and the header connector 104. The gap fillers 170 serve to lower the impedance of the signal contacts that extend through the gap between the receptacle and header connectors 102, 104. The gap fillers 170 are made from a material having a higher dielectric constant than air. In an exemplary embodiment, the gap fillers 170 are manufactured from a metal material. Alternatively, the gap fillers 170 may be manufactured from other materials, such as plastic materials.

Figure 2:
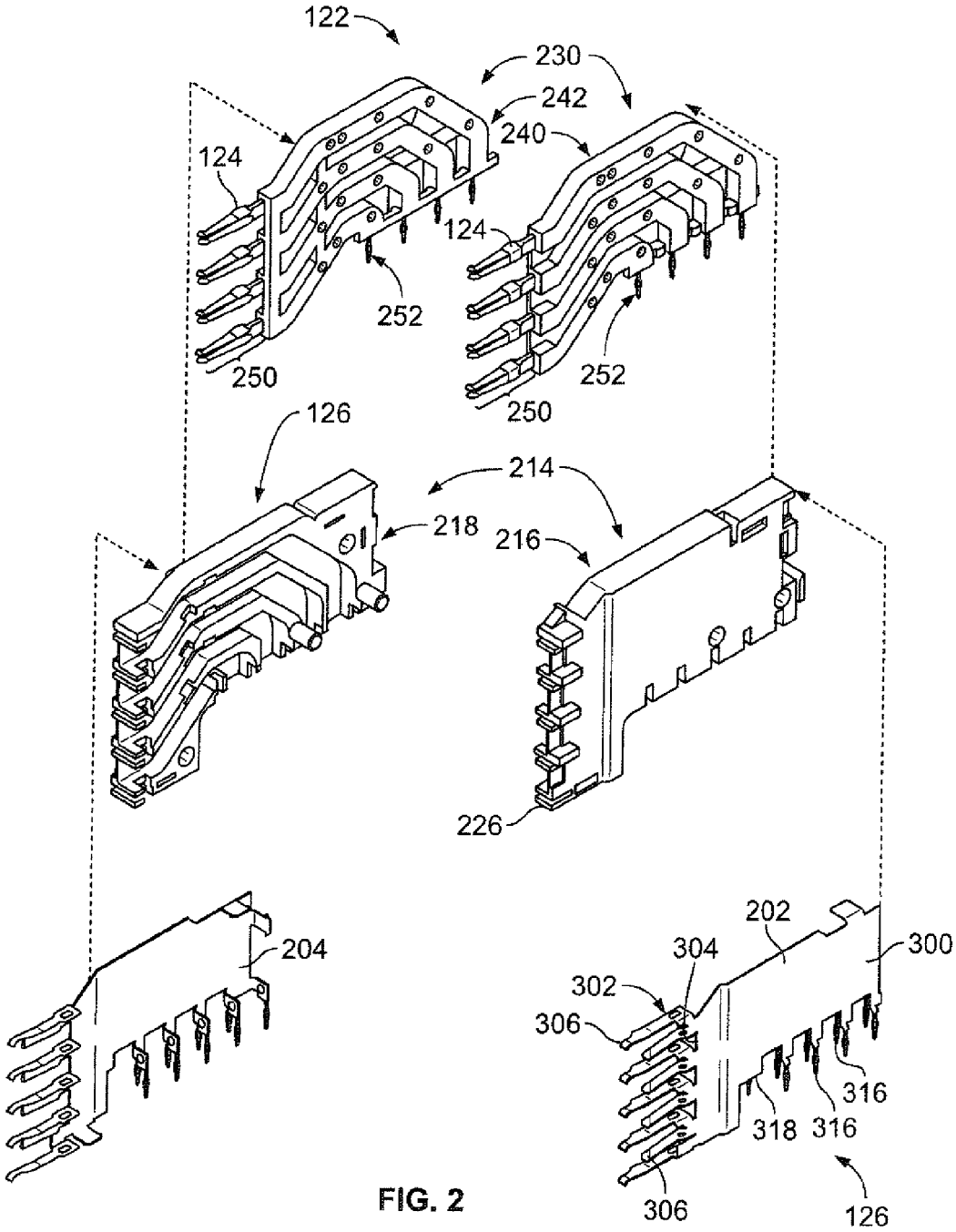
FIG. 2 is an exploded view of a contact module for the receptacle connector.

FIG. 2 is an exploded view of one of the contact modules 122 and part of the shield structure 126. The shield structure 126 includes a first ground shield 202 and a second ground shield 204. The first and the second ground shields 202, 204 electrically connect the contact module 122 to the header ground contacts 146 (shown in FIG. 1). The first and the second ground shields 202, 204 provide multiple, redundant points of contact to the header ground contact 146. For example, the first and the second ground shields may be configured to define at least two points of contact with each C-shaped header ground contact 146 (shown in FIG. 1). The first and the second ground shields 202, 204 provide shielding on all sides of the receptacle signal contacts 124.

The contact module 122 includes a holder 214 having a first holder member 216 and a second holder member 218 that are coupled together to form the holder 214. In an exemplary embodiment, the holder members 216, 218 are fabricated from a conductive material. For example, the holder members 216, 218 may be die-cast from a metal material. Alternatively, the holder members 216, 218 may be stamped and formed or may be fabricated from a plastic material that has been metalized or coated with a metallic layer. By having the holder members 216, 218 fabricated from a conductive material, the holder members 216, 218 may provide electrical shielding for the receptacle connector 102. When the holder members 216, 218 are coupled together, the holder members 216, 218 define at least a portion of the shield structure 126 of the receptacle connector 102. The first and second ground shields 202, 204 are mechanically and electrically coupled to the holder members 216, 218, respectively, to couple the ground shields 202, 204 to the holder 214.

The contact module 122 includes a frame assembly 230 held by the holder 214. The frame assembly 230 includes the receptacle signal contacts 124. In an exemplary embodiment, the frame assembly 230 includes a pair of dielectric frames 240, 242 surrounding the receptacle signal contacts 124. The receptacle signal contacts 124 may be initially held together as lead frames (not shown), which are overmolded with dielectric material to form the dielectric frames 240, 242. Other manufacturing processes may be utilized to form the contact modules 122, such as loading receptacle signal contacts 124 into a formed dielectric body.

The receptacle signal contacts 124 have mating portions 250 extending from a front wall of corresponding dielectric frame 240, 242. The receptacle signal contacts 124 have contact tails 252 extending from a bottom wall of the corresponding dielectric frame 240, 242. Other configurations are possible in alternative embodiments. In an exemplary embodiment, the mating portions 250 extend generally perpendicular with respect to the contact tails 252. Alternatively, the mating portions 250 and the contact tails 252 may be at any angle to each other. Inner portions or encased portions of the receptacle signal contacts 124 transition between the mating portions 250 and the contact tails 252 within the dielectric frames 240, 242.

The holder members 216, 218, which are part of the shield structure 126, provide electrical shielding between and around respective receptacle signal contacts 124. The holder members 216, 218 provide shielding from electromagnetic interference (EMI) and/or radio frequency interference (RFI). The holder members 216, 218 may provide shielding from other types of interference as well. The holder members 216, 218 provide shielding around the outside of the dielectric frames 240, 242 and thus around the outside of all of the receptacle signal contacts 124, such as between pairs of receptacle signal contacts 124, as well as between the pairs of receptacle signal contacts 124 to control electrical characteristics, such as impedance control, cross-talk control, and the like, of the receptacle signal contacts 124.

The first and second ground shields 202, 204 are similar to one another, and only the first ground shield 202 is described in detail herein, but the second ground shield 204 includes similar features. The first ground shield 202 includes a main body 300. In the illustrated embodiment, the main body 300 is generally planar.

The first ground shield 202 includes grounding beams 302 extending forward from a front 304 of the main body 300. The grounding beams 302 extend forward from the front 226 of the holder 214 such that the grounding beams 302 may be loaded into the receptacle housing 120 (shown in FIG. 1). Each grounding beam 302 has a mating interface 306 at a distal end thereof. The mating interface 306 is configured to engage the corresponding header ground contact 146.

The first ground shield 202 includes a plurality of ground pins 316 extending from a bottom 318 of the first ground shield 202. The ground pins 316 are configured to be terminated to the circuit board 106 (shown in FIG. 1). The ground pins 316 may be compliant pins, such as eye-of-the-needle pins, that are throughhole mounted to plated vias in the circuit board 106. Other types of termination means or features may be provided in alternative embodiments to couple the first ground shield 202 to the circuit board 106.

Figure 3:
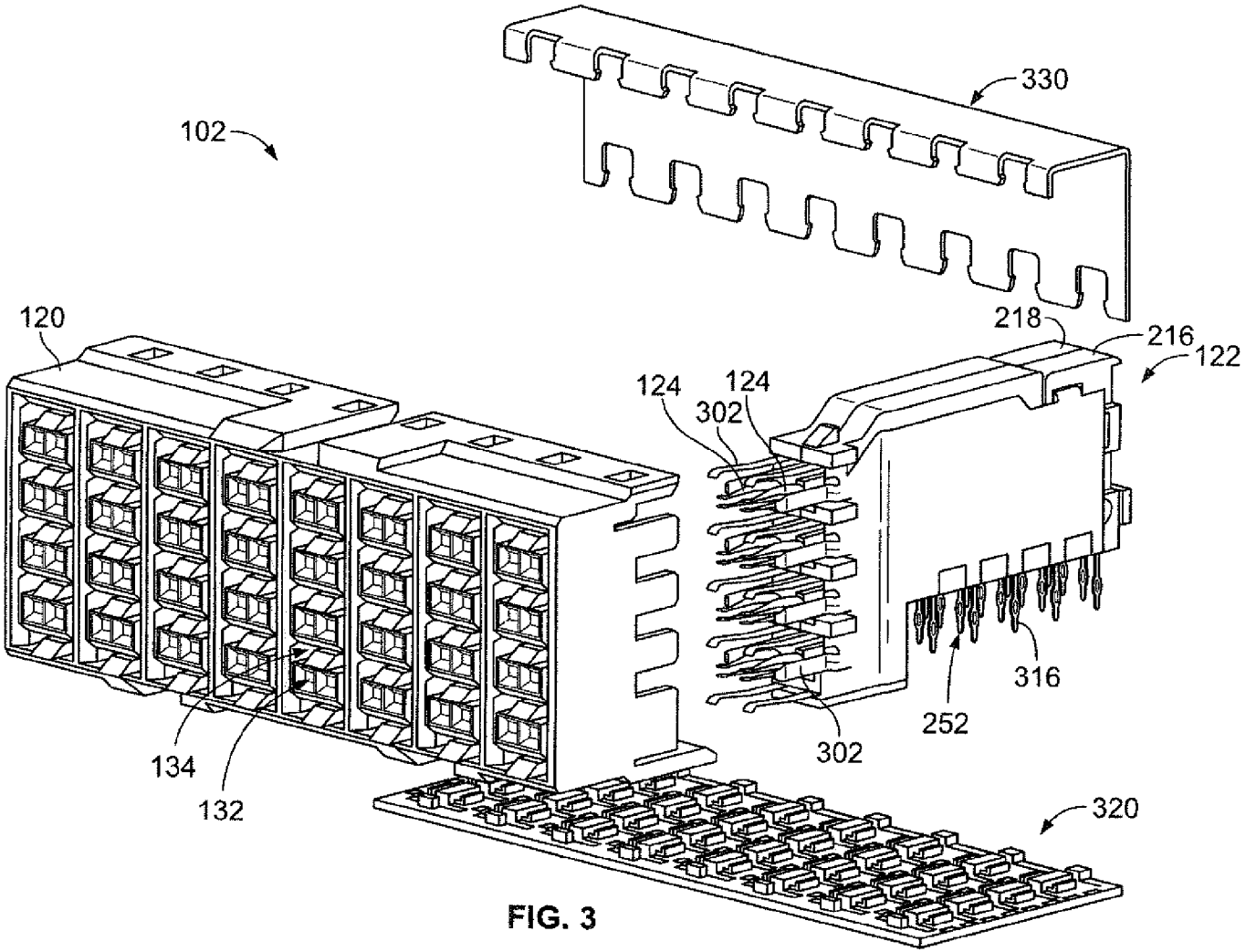
FIG. 3 is an exploded perspective view of the receptacle connector.

FIG. 3 is an exploded perspective view of the receptacle connector 102 showing one of the contact modules 122 in an assembled state poised for loading into the receptacle housing 120. During assembly, the dielectric frames 240, 242 (shown in FIG. 2) are received in the corresponding holder members 216, 218. The holder members 216, 218 are coupled together and generally surround the dielectric frames 240, 242. The dielectric frames 240, 242 are aligned adjacent one another such that the receptacle signal contacts 124 are aligned with one another and define contact pairs. Each contact pair is configured to transmit differential signals through the contact module 122. The receptacle signal contacts 124 within each contact pair are arranged in rows that extend along row axes. The receptacle signal contacts 124 within the dielectric frame 240 are arranged within a column along a column axis. Similarly, the receptacle signal contacts 124 of the dielectric frame 242 are arranged in a column along a column axis. The receptacle signal contacts 124 are loaded into corresponding signal contact openings 132. The grounding beams 302 are loaded into corresponding ground contact openings 134.

In an exemplary embodiment, the receptacle connector 102 includes a spacer 320. The spacer 320 holds the true positions of the contact tails 252 and the ground pins 316 for mounting to the circuit board 106 (shown in FIG. 1). In an exemplary embodiment, the receptacle connector 102 includes an organizer clip 330. The organizer clip 330 holds each of the contact modules 122 together as a unit.

Figure 4:
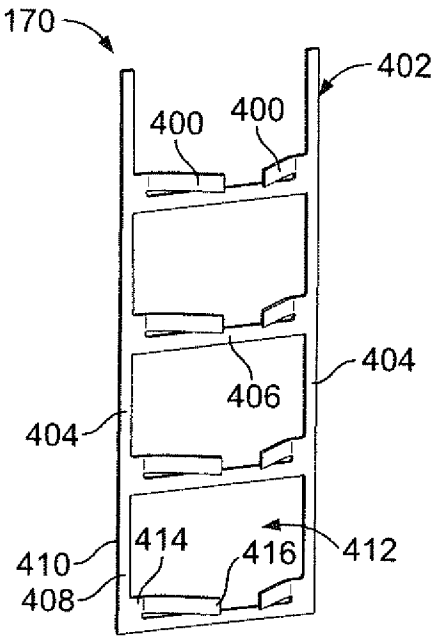
FIG. 4 is a front perspective view of a gap filler formed in accordance with an exemplary embodiment for the electrical connector system.

FIG. 4 is a front perspective view of the gap filler 170 formed in accordance with an exemplary embodiment. The gap filler 170 includes a plurality of spring fingers 400. The spring fingers 400 are deflectable and are configured to be received in the gap between the receptacle and header connectors 102, 104.

In the illustrated embodiment, the gap filler 170 includes a bracket 402 defined by side members 404 and cross members 406 extending between side members 404. The spring fingers 400 extend from the side members 404 and/or the cross members 406. In an exemplary embodiment, the bracket 402 is configured to be oriented such that the side members 404 extend vertically and the cross members 406 extend horizontally. Other configurations are possible in alternative embodiments. In an exemplary embodiment, the spring fingers 400 extend generally parallel to the cross members 406. The spring fingers 400 are bent out of the plane of the bracket 402. The spring fingers 400 are deflectable toward the plane of the bracket 402.

The bracket 402 includes a first side 408 and a second side 410. The bracket 402 includes openings 412 therethrough between the first side 408 and the second side 410. Any number of openings 412 may be provided, including a single opening. In the illustrated embodiment, each opening 412 includes a corresponding set of spring fingers 400. The spring fingers 400 are cantilevered and extend from a proximal end 414 to a distal end 416. The spring fingers 400 are angled between the proximal end 414 and the distal end 416.

Figure 5:
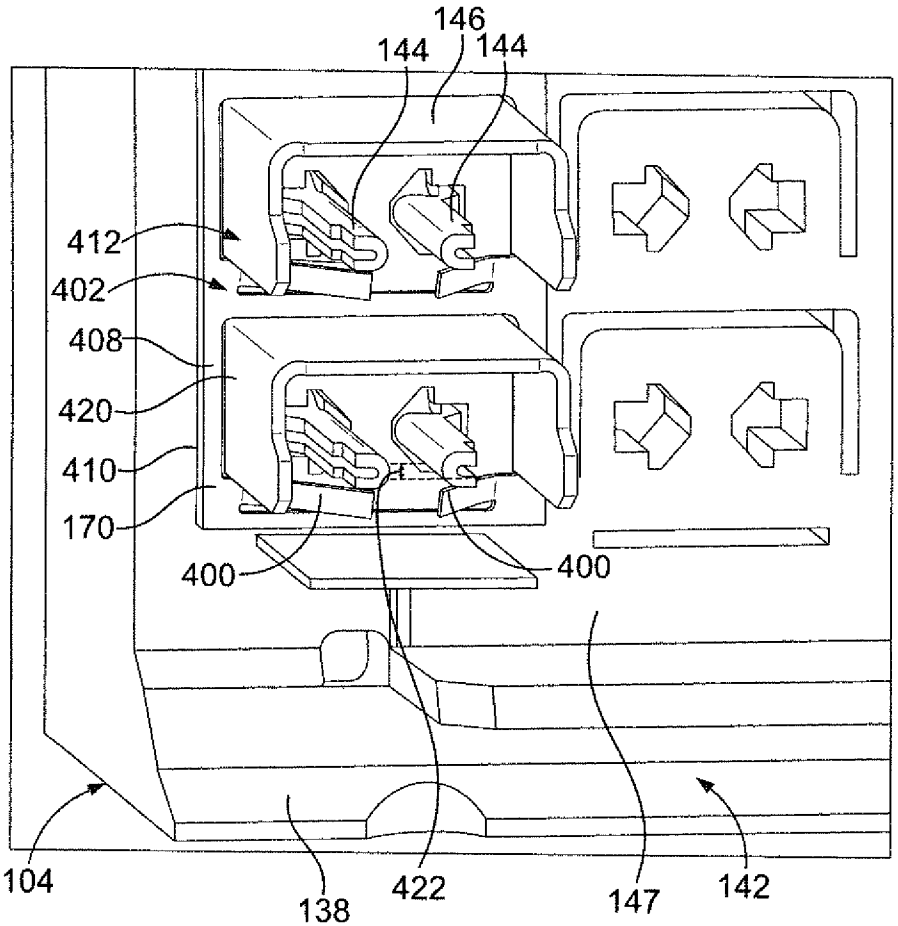
FIG. 5 shows a portion of the header connector with the gap filler mounted thereto.

FIG. 5 shows a portion of the header connector 104 with the gap filler 170 mounted thereto. The gap filler 170 is mounted to the header connector 104 at the front face 147 of the header housing 138. The second side 410 abuts against the front face 147. The spring fingers 400 extend away from the front face 147 into the chamber 142.

The gap filler 170 may be secured to the header connector 104, such as by using fasteners, tabs, adhesives, solder, an interference fit, heat staking, or other means or processes that attach the gap filler 170 to the header connector 104. In the illustrated embodiment, the header ground contact 146 includes protrusions 420, such as dimples, formed in the sheet metal of the header ground contacts 146. The protrusions 420 engage the first side 408. The gap filler 170 is held between the protrusions 420 and the front face 147. The gap fillers 170 may be used to common the header ground contact 146.

The gap filler 170 is coupled to the header connector 104 such that header ground contacts 146 and corresponding header signal contacts 144 extend through corresponding openings 412 and the bracket 402. The deflectable spring fingers 400 are positioned in close proximity to the header signal contacts 144. The spring fingers 400 are positioned far enough away from the header signal contacts 144 to ensure that electrical shorting does not occur. A spacing 422 between the spring fingers 400 and the header signal contacts 144 may be selected or controlled to achieve a desired electrical characteristic such as a target impedance for the header signal contacts 144.

Figure 6:
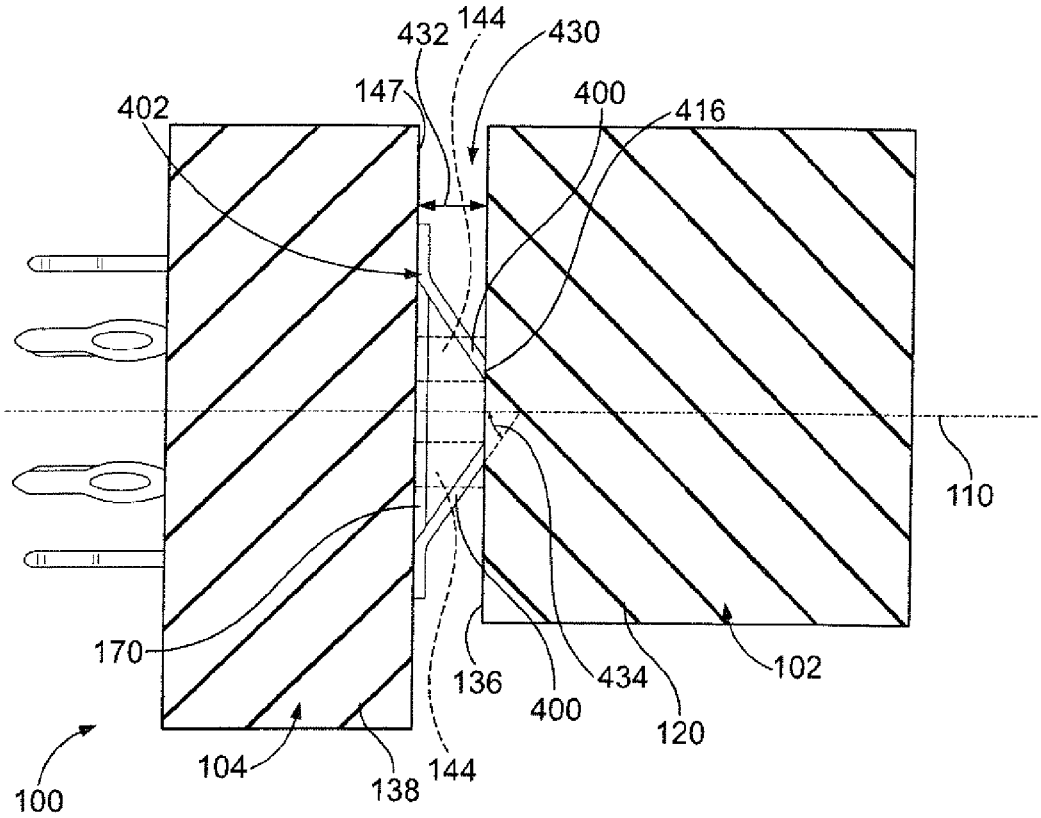
FIG. 6 is a top, partial sectional view of a portion of the electrical connector system showing the receptacle connector mated with the header connector.

FIG. 6 is a top, partial sectional view of a portion of the electrical connector system 100 showing the receptacle connector 102 mated with the header connector 104. When the receptacle connector 102 is coupled to the header connector 104, a gap 430 may be defined between the front face 136 of the receptacle housing 120 and the front face 147 of the header housing 138. Portions of the header signal contacts 144 (shown in phantom) may be exposed to air within the gap 430. Such exposure to air may affect the electrical characteristics of the header signal contacts 144. The exposure to air may cause the electrical performance to be outside of a certain specification or to be less than desirable.

The gap filler 170 is provided in the gap 430. The gap filler 170 provides impedance control for the header signal contacts 144 along the gap 430. The gap filler 170 is coupled to the header connector 104 such that the bracket 402 is mounted to the front face 147. The spring fingers 400 extend across the gap 430 and engage the front face 136 of the receptacle housing 120. In an exemplary embodiment, the size, shape and position of the spring fingers 400 may be selected to vary the amount of electrical interaction, such as the amount of capacitive coupling, with the header signal contacts 144 in a controlled manner that essentially offsets the detrimental effect of the air within the gap 430.

The spring fingers 400 of the gap filler 170 span the entire gap 430 between the front face 147 of the header housing and the front face 136 of the receptacle housing 120. For example, the combination of the bracket 402 and the spring fingers 400 spans the entire gap 430. The distal ends 416 of the spring fingers 400 engage the front face 136 of the receptacle housing 120. The spring fingers 400 are deflectable toward the front face 147 of the header housing 138 as the receptacle connector 102 is mated with the header connector 104.

The spring fingers 400 are movable within the gap 430 to change a relative position of the spring fingers 400 with respect to the header signal contacts 144. As the positions of the spring fingers 400 change relative to the header signal contacts 144, the amount of capacitive coupling between the spring fingers 400 and the header signal contacts 144 may be changed, which has an effect on the impedance of the header signal contacts 144. The amount of electrical interaction between the spring fingers 400 and the header signal contacts 144 is varied as a width 432 of the gap 430 changes. The amount of electrical interaction between the spring fingers 400 and the header signal contacts 144 is varied and may be controlled to achieve a target impedance. For example, as the width 432 decreases, the impedance effect of the air is diminished. As the width 432 decreases, the spring fingers 400 are pushed toward the front face 147 of the header housing 138 causing less interaction between the spring fingers 400 and the header signal contacts 144, such as less capacitive coupling therebetween. As the width 432 narrows, the effectiveness of the spring fingers 400 is diminished, however, as the width 432 of the gap 430 narrows the negative impact of the air in the gap 430 is also diminished.

The spring fingers 400 are angled relative to the mating axis 110 of the receptacle connector 102 and header connector 104, at an angle 434. The angle 434 of the spring fingers 400 depends on the width 432 of the gap 430. For example, as the width 432 narrows, the angle 434 changes.

Figure 7:
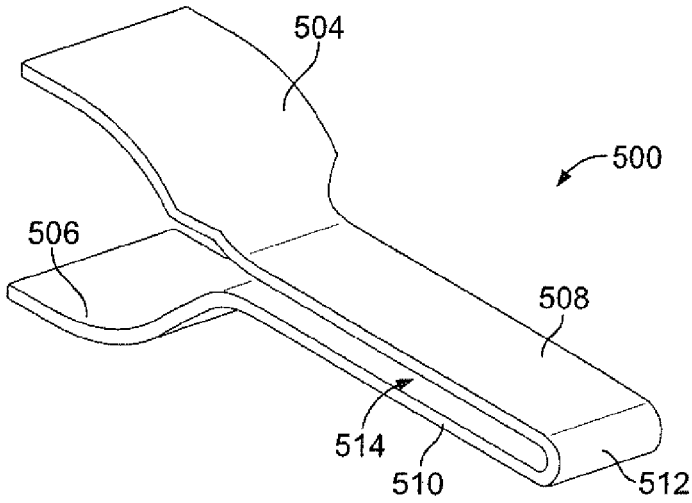
FIG. 7 is a front perspective view of a gap filler formed in accordance with an exemplary embodiment for the electrical connector system.

FIG. 7 is a front perspective view of an alternative gap filler 500 formed in accordance with an exemplary embodiment. The gap filler 500 constitutes a clip that is configured to be coupled to the header ground contacts 146. The gap filler 500 includes spring fingers 504, 506. The spring fingers 504,506 are configured to be positioned in proximity to different pairs of header signal contacts 144.

The gap filler 500 includes arms 508, 510 meeting at a hinge 512. A pocket 514 is defined between the arms 508, 510. The spring fingers 504, 506 are provided at ends of the arms 508, 510, respectively, opposite the hinge 512. In an exemplary embodiment, the spring fingers 504, 506 extend generally away from one another and are angled out with respect to the corresponding arms 508, 510. Optionally, the spring fingers 504, 506 may be curved. Alternatively, the spring fingers 504,506 may be flat.

Figure 8:
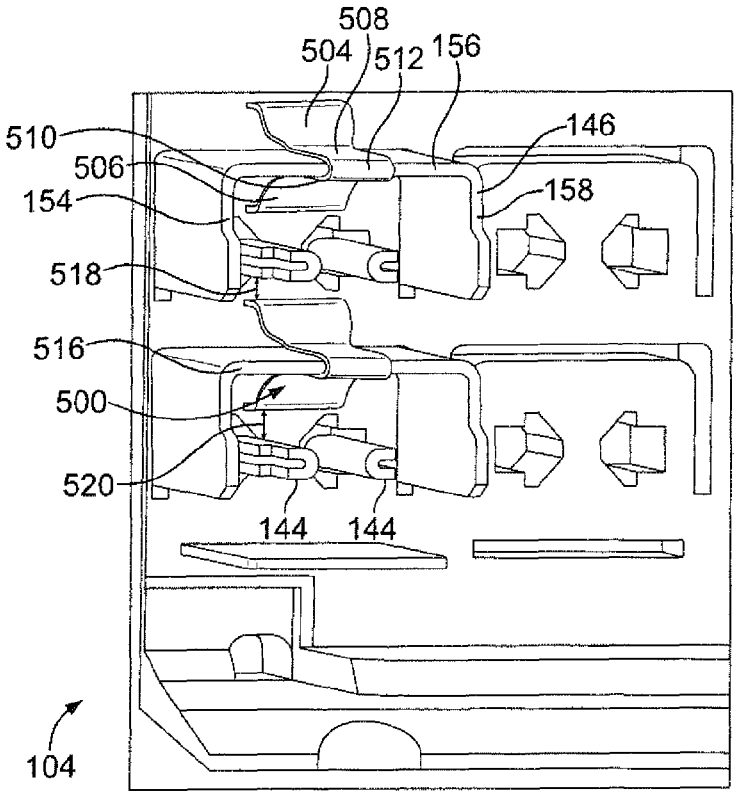
FIG. 8 is a front perspective view of a portion of the header connector with gap fillers shown in FIG. 7.

FIG. 8 is a front perspective view of a portion of the header connector 104 with gap fillers 500 coupled to corresponding header ground contacts 146. In an exemplary embodiment, each header ground contact 146 has a corresponding gap filler 500 coupled thereto. In the illustrated embodiment, the gap fillers 500 are coupled to the center walls 156 of the header ground contact 146. The gap fillers 500 are approximately centrally located between the side walls 154, 158. Optionally, the center wall 156 may include a slot 516 that receives the gap filler 500 and that positions the gap filler 500 with respect the center wall 156.

The gap fillers 500 are coupled to the center walls 156 such that the gap fillers 500 are received in the pockets 514 of the center walls 156 of the header ground contacts 146. The arms 508, 510 extend along upper and lower surfaces of the center walls 156. The hinges 512 bias the arms 508, 510 against the center walls 156 to hold the gap fillers 500 on the header ground contacts 146. Optionally, retaining features may be provided, such as dimples or lances, to secure the gap fillers 500 to the header ground contacts 146.

The spring fingers 504 extend from the arms 508 generally toward the pair of header signal contacts 144 above the gap filler 500. A spacing 518 is defined between the spring finger 504 and the pair of header signal contacts 144. The spacing 518 may be controlled to achieve a target impedance for the header signal contacts 144 based on a width of a gap defined between the receptacle connector 102 (shown in FIG. 1) and the header connector 104.

The spring fingers 506 extend from the arms 510 generally toward the pair of header signals contacts 144 below the gap filler 500. A spacing 520 is defined between the spring finger 506 and the pair of header signal contacts 144. The spacing 520 may be controlled to achieve a target impedance for the header signal contacts 144 based on a width of a gap defined between the receptacle connector 102 (shown in FIG. 1) and the header connector 104.

Figure 9:
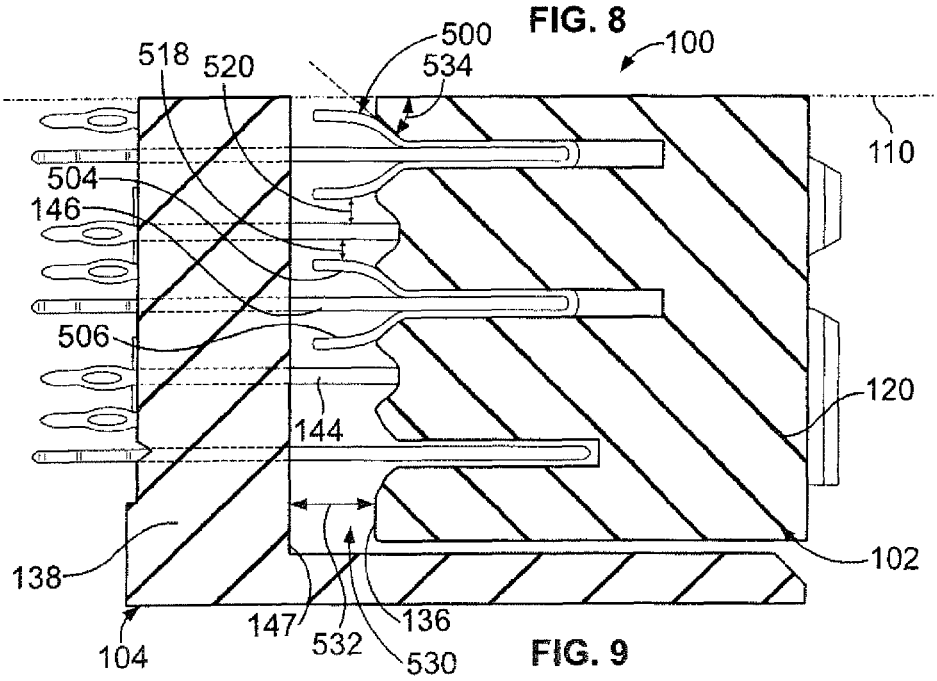
FIG. 9 is a side, partial sectional view of the electrical connector system showing the gap fillers shown in FIG. 7.

FIG. 9 is a side, partial sectional view of the electrical connector system 100 using the gap fillers 500 to provide impedance control for the header signal contacts 144. When the receptacle connector 102 is coupled to the header connector 104, a gap 530 may be defined between the front face 136 of the receptacle housing 120 and the front face 147 of the header housing 138. Portions of the header signal contacts 144 (shown in phantom) may be exposed to air within the gap 530. Such exposure to air may affect the electrical characteristics of the header signal contacts 144.

The gap filler 500 is provided in the gap 530. The gap filler 500 provides impedance control for the header signal contacts 144 along the gap 530. The spring fingers 504, 506 extend across the gap 530. Optionally, the spring fingers 504, 506 may extend across a majority of the gap 530. The spring fingers 504, 506 engage the front face 136 of the receptacle housing 120. In an exemplary embodiment, the size, shape and position of the spring fingers 504, 506 may be selected to vary the amount of electrical interaction, such as the amount of capacitive coupling, with the header signal contacts 144 in a controlled manner that essentially offsets the detrimental effect of the air within the gap 530.

The spring fingers 504, 506 are movable within the gap 530 to change a relative position of the spring fingers 504, 506 with respect to the header signal contacts 144. For example, the spring fingers 504, 506 are deflectable toward the upper and lower surfaces of the corresponding header ground contact 146, and away from the header signal contacts 144, as the receptacle connector 102 is mated with the header connector 104. As the spacings 518, 520 of the spring fingers 504, 506 change relative to the header signal contacts 144, the amount of capacitive coupling between the spring fingers 504, 506 and the header signal contacts 144 may be changed, which has an effect on the impedance of the header signal contacts 144.

The spacings 518, 520 between the spring fingers 504, 506 and the header signal contacts 144 are varied as a width 532 of the gap 530 changes. The amount of electrical interaction between the spring fingers 504, 506 and the header signal contacts 144 is varied and may be controlled to achieve a target impedance. For example, as the width 532 decreases, the impedance effect of the air is diminished. As the width 532 decreases, the spring fingers 504, 506 are pushed away from the header signal contacts 144 causing less interaction between the spring fingers 504, 506 and the header signal contacts 144. As the width 532 narrows, the effectiveness of the spring fingers 504, 506 is diminished, however, as the width 532 of the gap 530 narrows the negative impact of the air in the gap 530 is also diminished.

The spring fingers 504, 506 are angled relative to the mating axis 110 of the receptacle connector 102 and header connector 104, at an angle 534. The angle 534 of the spring fingers 504, 506 depends on the width 532 of the gap 530. For example, as the width 532 narrows, the angle 534 changes.

Figure 10:
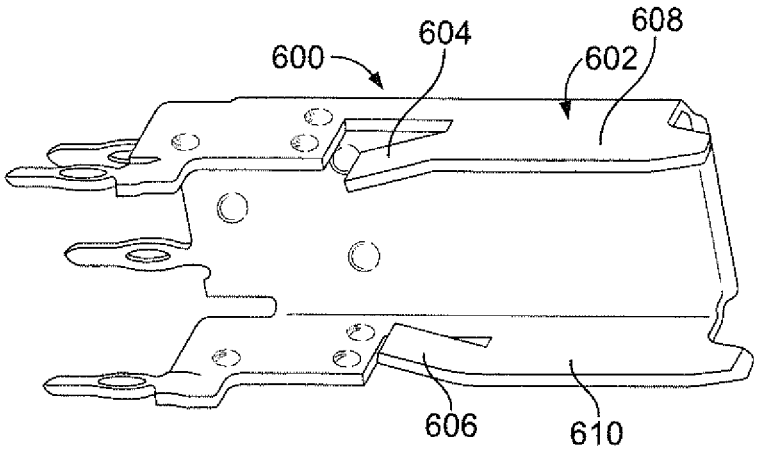
FIG. 10 illustrates gap fillers formed in accordance with an exemplary embodiment for the electrical connector system.

FIG. 10 illustrates gap fillers 600 formed integral with a header ground contact 602. A header ground contact 602 may be used in place of the header ground contact 146 (shown in FIG. 1) within the header connector 104 (shown in FIG. 1). The header ground contact 602 may be substantially similar to the header ground contact 146, however the header ground contact 602 includes spring fingers 604, 606 formed in sidewalls 608, 610 of the header ground contact 602. The spring fingers 604, 606 are stamped and formed from the sidewalls 608, 610. The spring fingers 604, 606 are bent inward into the space of the header ground contact 602 that receives header signal contacts, such as the header signal contacts 144 (shown in FIG. 1). The spring fingers 604, 606 are deflectable. The spring fingers 604, 606 are manufactured from electrically conducted material, such as a metal material.

Figure 11:
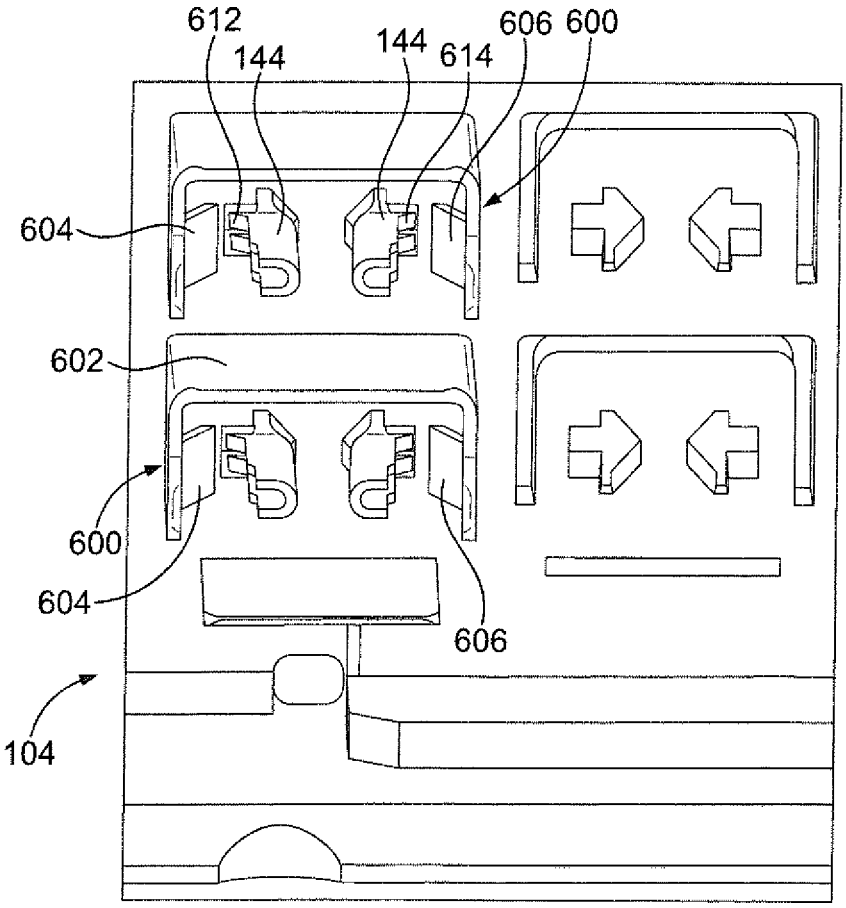
FIG. 11 is a front perspective view of a portion of the header connector with the gap fillers shown in FIG. 10.

FIG. 11 is a front perspective view of a portion of the header connector 104 using the header ground contact 602 rather than the header ground contacts 146 (shown in FIG. 1). Utilizing the header ground contacts 602 with the gap fillers 600 incorporated therein eliminates the need for the gap filler 170 (shown in FIG. 1). The spring fingers 604, 606 are bent inward toward the header signal contacts 144. A spacing 612 is defined between the spring fingers 604 and the corresponding nearest header signal contact 144. A spacing 614 is defined between a spring finger 606 and the corresponding nearest header signal contact 144. The spacings 612, 614 are controlled to provide impedance control for the header signal contacts 144 along a gap defined between the receptacle connector 102 (shown in FIG. 1) and the header connector 104.

Figure 12:
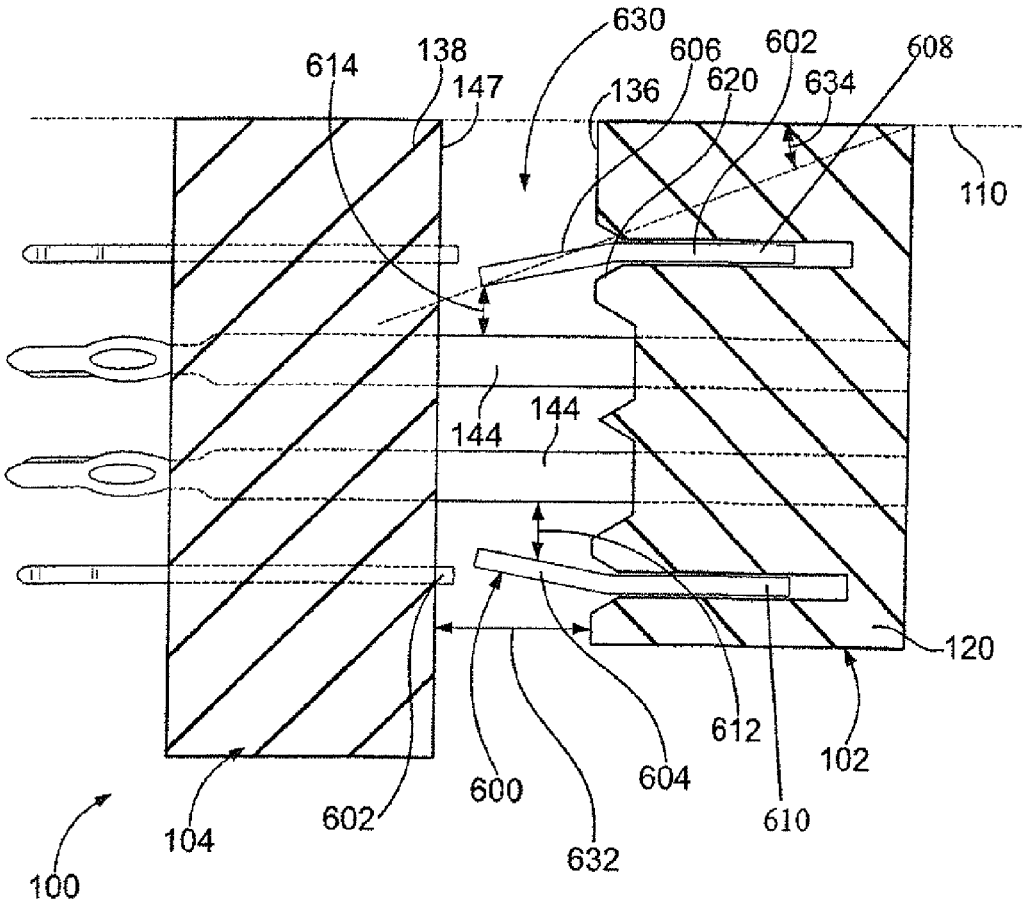
FIG. 12 is a top, partial sectional view of a portion of the electrical connector system utilizing the gap fillers shown in FIG. 10.

FIG. 12 is a top, partial sectional view of a portion of the electrical connector system 100 utilizing the header ground contacts 602 and gap fillers 600 rather than the header ground contacts 146 and gap fillers 170 (both shown in FIG. 1). When the receptacle connector 102 is coupled to the header connector 104, a gap 630 may be defined between the front face 136 of the receptacle housing 120 and the front face 147 of the header housing 138. Portions of the header signal contacts 144 (shown in phantom) may be exposed to air within the gap 630. Such exposure to air may affect the electrical characteristics of the header signal contacts 144.

The gap fillers 600 are provided in the gap 630. The gap fillers 600 provide impedance control for the header signal contacts 144 along the gap 630. The spring fingers 604, 606 extend across the gap 630. Optionally, the spring fingers 604, 606 may extend across a majority of the gap 630. The spring fingers 604, 606 engage the front face 136 of the receptacle housing 120. In an exemplary embodiment, the size, shape and position of the spring fingers 604, 606 may be selected to vary the amount of electrical interaction, such as the amount of capacitive coupling, with the header signal contacts 144 in a controlled manner that essentially offsets the detrimental effect of the air within the gap 630.

The spring fingers 604, 606 are movable within the gap 630 to change a relative position of the spring fingers 604, 606 with respect to the header signal contacts 144. For example, the spring fingers 604, 606 are deflectable away from the header signal contacts 144 as the receptacle connector 102 is mated with the header connector 104. The receptacle connector 102 may have angled guide walls 620 that guide opening of the spring fingers 604, 606 at a controlled rate to control the electrical interaction of the spring fingers 604, 606 with the header signal contacts 144. The angle of the guide walls 620 may control the positioning of the spring fingers 604, 606 as the receptacle connector 102 is moved toward the header connector 104. As the spacings 612, 614 of the spring fingers 604, 606 change relative to the header signal contacts 144, the amount of capacitive coupling between the spring fingers 604, 606 and the header signal contacts 144 may be changed, which has an effect on the impedance of the header signal contacts 144.

The spacings 612, 614 between the spring fingers 604, 606 and the header signal contacts 144 are varied as a width 632 of the gap 630 changes. The amount of electrical interaction between the spring fingers 604, 606 and the header signal contacts 144 is varied and may be controlled to achieve a target impedance. For example, as the width 632 decreases, the impedance effect of the air is diminished. As the width 632 decreases, the spring fingers 604, 606 are pushed away from the header signal contacts 144 causing less interaction between the spring fingers 604, 606 and the header signal contacts 144. As the width 632 narrows, the effectiveness of the spring fingers 604, 606 is diminished, however, as the width 632 of the gap 630 narrows the negative impact of the air in the gap 630 is also diminished.

The spring fingers 604, 606 are angled relative to the mating axis 110 of the receptacle connector 102 and header connector 104, at an angle 634. The angle 634 of the spring fingers 604, 606 depends on the width 632 of the gap 630. For example, as the width 632 narrows, the angle 634 changes. Optionally, when the gap 630 is closed (e.g. has a width of zero), the spring fingers 604, 606 may be in plane with the sidewalls 608, 610, and may be generally parallel to the header signal contacts 144.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector system comprising:

a receptacle connector comprising a receptacle housing holding a plurality of receptacle signal contacts, the receptacle signal contacts being arranged in pairs carrying differential signals, the receptacle housing having a front face;

a header connector coupled to the receptacle connector, the header connector comprising a header housing holding a plurality of header signal contacts, the header signal contacts being arranged in pairs carrying differential signals, the header signal contacts being mated with corresponding receptacle signal contacts, the header housing having a front face, wherein the front face opposes the front face of the receptacle housing when coupled thereto with a gap being defined between the front faces; and gap fillers within the gap, the gap fillers being conductive, the gap fillers comprising deflectable spring fingers, the gap fillers providing impedance control for the header signal contacts along the gap.

2. The electrical connector system of claim 1, wherein the spring fingers are movable within the gap to change a relative position of the spring fingers with respect to the header signal contacts.

3. The electrical connector system of claim 1, wherein the spring fingers engage the front face of the receptacle housing.

4. The electrical connector system of claim 1, wherein the gap fillers span the entire gap between the front face of the header housing and the front face of the receptacle housing.

5. The electrical connector system of claim 1, wherein spacings between the spring fingers and the header signal contacts are varied as width of the gap changes.

6. The electrical connector system of claim 1, wherein a spacing between the spring fingers and the header signal contacts is controlled to achieve a target impedance.

7. The electrical connector system of claim 1, wherein the gap fillers comprise brackets having frames with the spring fingers extending from the frames, the frames being mounted flushed with the front face of the header housing, the spring fingers extending to distal ends, the distal ends engaging the front face of the receptacle housing, the spring fingers being deflectable toward the front face of the header housing as the receptacle connector is mated with the header connector.

8. The electrical connector system of claim 1, wherein the header connector includes a plurality of header ground contacts held by the header housing, the header ground contacts being mechanically and electrically coupled to a shield body of the receptacle connector to provide ground paths between the header connector and the receptacle connector, the header ground contacts spanning across the gap, the gap fillers comprise clips separately provided from and mounted to, the header ground contacts.

9. The electrical connector system of claim 1, wherein the header connector includes a plurality of header ground contacts held by the header housing, the header ground contacts being mechanically and electrically coupled to a shield body of the receptacle connector to provide ground paths between the header connector and the receptacle connector, the header ground contacts have walls at least partially surrounding corresponding pairs of the receptacle signal contacts, the gap fillers comprise clips separately provided from, and mounted to, corresponding walls of the header ground contacts such that the spring fingers of the gap fillers are positioned between the walls and corresponding receptacle signal contacts.

10. The electrical connector system of claim 1, wherein the header connector comprises a plurality of header ground contacts held by the header housing, the header ground contacts being mechanically and electrically coupled to a shield body of the receptacle connector to provide ground paths between the header connector and the receptacle connector, the spring fingers of the gap fillers being integral with the header ground contacts.

11. The electrical connector system of claim 1, wherein the spring fingers are angled relative to a mating axis of the receptacle connector, angles of the spring fingers being dependent on a width of the gap.

12. An electrical connector system comprising:

a receptacle connector comprising a receptacle housing holding a plurality of receptacle signal contacts, the receptacle signal contacts being arranged in pairs carrying differential signals, the receptacle housing having a front face, the receptacle connector having a shield body;

a header connector coupled to the receptacle connector, the header connector comprising a header housing holding a plurality of header signal contacts and a plurality of header ground contacts, the header signal contacts being arranged in pairs carrying differential signals, the header signal contacts being mated with corresponding receptacle signal contacts, the header ground contacts being mechanically and electrically coupled to the shield body to provide ground paths between the header connector and the receptacle connector, the header housing having a front face, wherein the front face opposes the front face of the receptacle housing when coupled thereto with a gap being defined between the front faces, the header signal contacts and the header ground contacts spanning across the gap; and gap fillers within the gap, the gap fillers being separate from the header connector and coupled to the header ground contacts, the gap fillers being conductive and being electrically connected to the header ground contacts, the gap fillers comprising deflectable spring fingers spanning across the gap, the gap fillers providing impedance control for the header signal contacts along the gap.

13. The electrical connector system of claim 12, wherein the gap fillers comprise brackets having frames with the spring fingers extending from the frames, the frames being mounted flush with the front face of the header housing, the spring fingers extending to distal ends, the distal ends engaging the front face of the receptacle housing, the spring fingers being deflectable toward the front face of the header housing as the receptacle housing connector is mated with the header connector.

14. The electrical connector system of claim 12, wherein the gap fillers comprise clips separately provided from, and mounted to, the header ground contacts.

15. The electrical connector system of claim 12, wherein the header ground contacts comprise a plurality of walls defining C-shaped header ground contacts, the gap fillers comprises clips separately provided from, and mounted to, corresponding walls of the header ground contacts such that the spring fingers of the gap fillers are positioned between such wall and the corresponding header signal contacts.

16. The electrical connector system of claim 12, wherein the header ground contacts include protrusions extending therefrom, the gap fillers being coupled to the header connector such that the gap fillers are held between the protrusions and the front face of the header housing.

17. An electrical connector system comprising:

a receptacle connector comprising a receptacle housing holding a plurality of receptacle signal contacts, the receptacle signal contacts being arranged in pairs carrying differential signals, the receptacle housing having a front face, the receptacle connector having a shield body;

a header connector coupled to the receptacle connector, the header connector comprising a header housing holding a plurality of header signal contacts and a plurality of header ground contacts, the header signal contacts being arranged in pairs carrying differential signals, the header signal contacts being mated with corresponding receptacle signal contacts, the header ground contacts being mechanically and electrically coupled to the shield body to provide ground paths between the header connector and the receptacle connector, the header housing having a front face, wherein the front face opposes the front face of the receptacle housing when coupled thereto with a gap being defined between the front faces, the header signal contacts and the header ground contacts spanning across the gap; and gap fillers within the gap, the gap fillers being separate from the header connector and coupled to the header ground contacts, the gap fillers being integrally formed with the header ground contacts, the gap fillers comprising deflectable spring fingers spanning across the gap, the gap fillers providing impedance control for the header signal contacts along the gap.

18. The electrical connector system of claim 17, wherein the header ground contacts are C-shaped having sidewalls and a main wall extending between the sidewalls, the spring fingers being integrally formed with the sidewalls.

19. The electrical connector system of claim 17, wherein the header signal contacts of each pair are arranged in rows along row axes, the gap fillers providing two spring fingers between each adjacent pair of header signal contacts along the corresponding row axis.

20. The electrical connector system of claim 17, wherein the spring fingers are movable within the gap to change a relative position of the spring fingers with respect to the header signal contacts.

* * * * *